United States Patent [19]

Fritzvold et al.

[11] 4,279,694

[45] Jul. 21, 1981

[54] METHOD FOR TREATING REFINED MECHANICAL PULP AND THERMO MECHANICAL PULP WITH OZONE

[75] Inventors: Bjorn H. Fritzvold, Hosle; Nicolai Soteland, Oslo, both of Norway

[73] Assignee: Myrens Verksted A/S, Norway

[21] Appl. No.: 101,146

[22] Filed: Dec. 7, 1979

Related U.S. Application Data

[63] Continuation of Ser. No. 942,774, Sep. 15, 1978, abandoned.

[30] Foreign Application Priority Data

Oct. 17, 1977 [NO] Norway ..... 773560

[51] Int. Cl.[3] ..... D21B 1/14; D21C 9/10

[52] U.S. Cl. ..... 162/28; 162/65

[58] Field of Search ..... 162/65, 71, 24, 25, 162/28

[56] References Cited

U.S. PATENT DOCUMENTS 4,123,317 10/1978 Fritzvold et al. ..... 162/65

FOREIGN PATENT DOCUMENTS 2444475 4/1975 Fed. Rep. of Germany ..... 162/24

OTHER PUBLICATIONS

Norsk Skogindustri Oct. 1973 pp. 274–277.

Norsk Skogindustri Feb. 1968 pp. 46–52.

*Primary Examiner*—William F. Smith

*Attorney, Agent, or Firm*—Holman & Stern

[57] ABSTRACT

When treating refined mechanical pulp and thermo mechanical pulp with ozone, it is of great importance that the process be carried out at the most favorable conditions and with a minimum consumption of energy. According to the present invention the pulp is refined to a freeness value of at least 200 csf in a first stage refiner from which the pulp is passed to a high consistency ozonizer and maturation reactor for a time limited to maximum 30 minutes. From the reactor the pulp is passed direct to a second stage refiner, the pulp then having a solids content of approximately 8–10% and an alkaline value in the range of 7–10.

5 Claims, 10 Drawing Figures

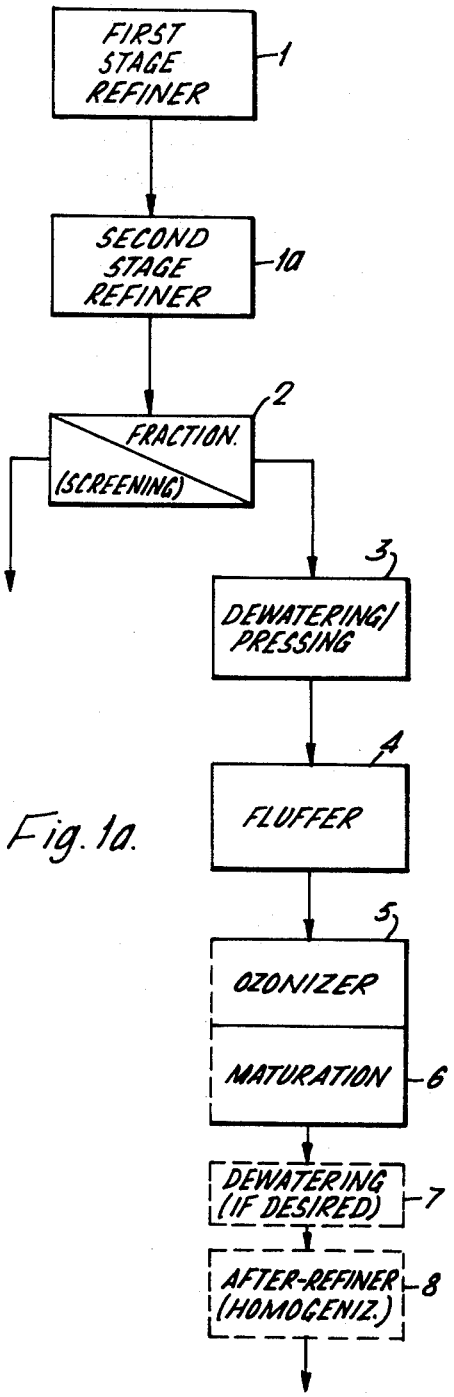
Fig. 1a.
Fig. 1b.
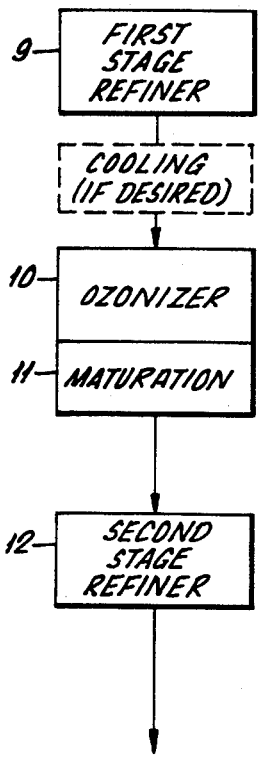

DISCHARGE OF $BOF_7$, kg/odt RELATIVE TO FREENESS CSF IN THE PRODUCTION OF OZONE TREATED REFINED MECHANICAL PULP $BOF_7$ = BIOLOGIC OXYGEN DEMAND MEASURED FOR 7 DAYS

METHOD FOR TREATING REFINED MECHANICAL PULP AND THERMO MECHANICAL PULP WITH OZONE

This is a continuation of application Ser. No. 942,774, filed Sept. 15, 1978 abandoned.

BACKGROUND OF THE INVENTION

1. Field of the Art

The present invention relates to a method for treating refined mechanical pulp and thermo mechanical pulp with ozone, wherein the pulp is treated in an ozone reactor immediately after one or more processing steps in a disc refiner and thereafter is treated with high consistency in a maturation reactor.

More particularly the present invention relates to a method of treating refined mechanical pulp (Refined Mechanical Pulp, RMP) and thermo mechanical pulp (Thermo Mechanical Pulp, TMP) with ozone between two associated refining steps.

2. Statement of Prior Art

It is previously known that in treating mechanical pulps with ozone the properties of the pulp can be improved considerably, see in this respect for example Norsk Skogindustri No. 2 (1968) 46, No. 3 (1972) 61, No. 5 (1971) 135, No. 10 (1973) 274, No. 6 (1974) 165 and NO-PS 115 279.

Further, in Norwegain Patent Application No. 75 3661 there is described a method and an apparatus for treating finely divided pulp with ozone gas without overpressure, in which the ozone treated pulp is subjected to a low consistency maturation. A further development of this method and apparatus is described in Norwegian Patent Application No. 77 1473, according to which the ozone treated pulp is brought direct into a high consistency maturation reactor, which is so designed that the total processing time represented by the gas phase reaction time the maturation time is considerably reduced. Accordingly, also the size of the process equipment is reduced, a combined maturation and bleaching of the pulp being accomplished without auxiliary equipment.

In NO-PS 131 996 there is described a method for treating paper pulp with ozone which is to the effect that the pulp is refined in a disc refiner at high consistency, the pulp immediately thereafter being subjected to an ozone treatment. Thereby is achieved a pulp having an especially appropriate consistency and a favourable physical condition —i.e. a light and fluffy or so-called fluffed pulp —for the ozone treatment without the use of particular dewatering and fluffer equipment.

However, this Patent Specification renders no concrete instructions for what freeness or what dewatering properties the pulp should have during the ozone treatment or how many processing stages the pulp should go through in the disc refiners. Nor does this Patent Specification provide any instructions for a treatment of the pulp subsequent to the ozone treatment, which in view of the preceding treatment consumes considerably less energy and gives a finished pulp having further favourable tear and tensile strength qualities.

In Norwegian Patent Application No. 77 1471 there is disclosed a method for treating pulp with ozone, which suggests that the finished defibrated pulp be fractionated prior to the ozone treatment thereby taking advantage of the condition that a pulp obtains a larger tear strength, the higher the freeness of the pulp is during the ozone treatment.

Further, Norwegian Patent Application No. 77 1472 gives instructions for a method which takes advantage of the above-mentioned condition in connection with reject pulps.

If the prior art was taken as a starting point for achieving a pulp having such a freeness number that it is suited for ozone treatment, the following two procedures would be followed.

(1) The pulp is fractionated, a fact which entails a dilution of the pulp to so-called screening consistency, which usually means solids content of approximately 1%, to fractionate the coarse fraction. This is then subjected to dewatering and fulffing before the ozone treatment.

(2) A reject pulp is used, which per definition is a coarse pulp, and this pulp is concentrated and fluffed before the ozone treatment, whereafter the ozonized pulp is passed through a conventional reject treatment.

As described in Norwegian Patent Applications Nos. 77 1471 and 77 1472, an ozone treatment of a coarse pulp achieves an energy reduction compared to the same treatment of a more finely divided pulp, the necessary energy for the dewatering/pressing being reduced with increasing freeness of the pulp. The total energy necessary for dewatering a pulp having a freeness of approximately 100 csf (Canadian Standard Freeness) to approximately 35% TS (solids) lies in the range of 60 kwh/odt (oven dry ton), and only a minor part of this energy can be saved in the use of a coarser pulp produced by fractionation or represented by reject pulp.

Thus, the object of the present invention is to provide a method which makes a complete integration of the ozone treatment in the pulp production process possible, and which affords a substantial reduction of the energy consumption when the entire pulp production process is looked upon as a whole. Further, an object of the invention is to give instructions for a method which permits a substantial simplification of the equipment involved in the process-technical plant.

SUMMARY OF THE INVENTION

According to the invention these objects are achieved in that the ozone treatment takes place under specific conditions between two associated refining steps, so that the ozone treatment constitutes a completely integrated link between a first and a second refining step in a continuous pulp production process, and the method according to the invention is characterized by (a) refining the pulp to a freeness value of at least 200 csf, preferably 400 csf before the pulp is subjected to ozone treatment, (b) allowing the ozone treated pulp to reside in the high consistency reactor for a time limited to not more than 30 minutes, preferably less than 10 minutes, and (c) passing the pulp from the reactor direct and continuously to a disc refiner or other grinding device, the pulp having a consistency of approximately 8–40%, preferably approximately 16–25%, and having an alkaline pH-value in the range of 7–10.

The above-mentioned features involve a method for treating RMP and TMP with ozone, which permits a substantial reduction of the energy consumption, a reduction in the range of 200–500 kwh/odt, the method requiring a process-technical layout for the pulp production which is substantially simplified relative to apparatus used in known methods of this type.

Even if the above-mentioned known ozone treatments per se can be accomplished on pulps having a wide range of consistency as well as freeness, no concrete values of these ranges have ever been stated which permit the favourable results achieved in the present method. Preferably the pulp should be refined at the stated freeness value when having a dry substance consistency of approximately 20–60%.

Before the refined pulp from the disc refiner is passed to the ozone reactor it should have a temperature below approximately 70° C. to render the ozone treatment as effective as possible. In the high consistency maturation reactor in which the ozone treated pulp resides in an alkaline environment for less than 30 minutes, preferably below 10 minutes, bleaching chemicals may, if desired, be added to the pulp.

In the refiner following the high consistency maturation reactor the pulp is ground to the freeness level of the final product, which for newspaper and magazine paper usually lies in the range 80–130 csf.

Conventional refining of the pulp to, for example, newspaper or magazine paper by the use of a disc refiner usually takes place in a two step plant. Based on today's techniques, the optimum distribution of the energy between the two refiners is in the range of 60–75% on the first step and 25–40% on the second step, a fact which after the first step refining of the pulp lends to the pulp a freeness value in the range of 200–250 csf on a "latency"-free pulp (i.e. after the fibres have been subjected to a "latency"-treatment for removal of the inner tensions in the pulp fibres).

Beyond a pure energy economizing factor there is a series of factors underlying the energy distribution between the two refiner steps. A factor of particular interest is the tear strength. If in connection with known technique a pulp should be refined to newspaper or magazine paper by choosing a high freeness level, for example 500–700 csf after the first refining step for thereafter being ground to approximately 100 csf in the second refining step, this would result in an increased fibre cutting and accordingly a weaker pulp which primarily is characterized in a lower tear strength, since a larger quantity of energy has to be used for grinding the pulp in the second step (a fact which in practice is done by reducing the gap opening between the discs of the refiner).

Also the problem of fibre cutting and small tear strength is resolved in the method according to the invention, since the refining of the alkaline high consistency fibre pulp which has been treated with ozone according to the present method, requires a comparatively small quantity of energy for grinding the pulp to a desired freeness in the second refiner step. According to the present invention, such a large reduction of the energy requirement in the mentioned second refining stage results in the total energy consumption represented by the first and second step of refinement as well as the ozone treatment being less than the energy consumption necessary for grinding the pulp to the desired freeness according to conventional technique.

The invention will be further described as follows, reference being made to the drawings.

BRIEF DESCRIPTION OF THE DRAWINGS

FIGS. 1*a* and 1*b* are simplified flow diagram of a known method for treating cellulose containing pulp with ozone and of the method according to the present invention, respectively.

DESCRIPTION OF PREFERRED EMBODIMENTS

Figure 2A:
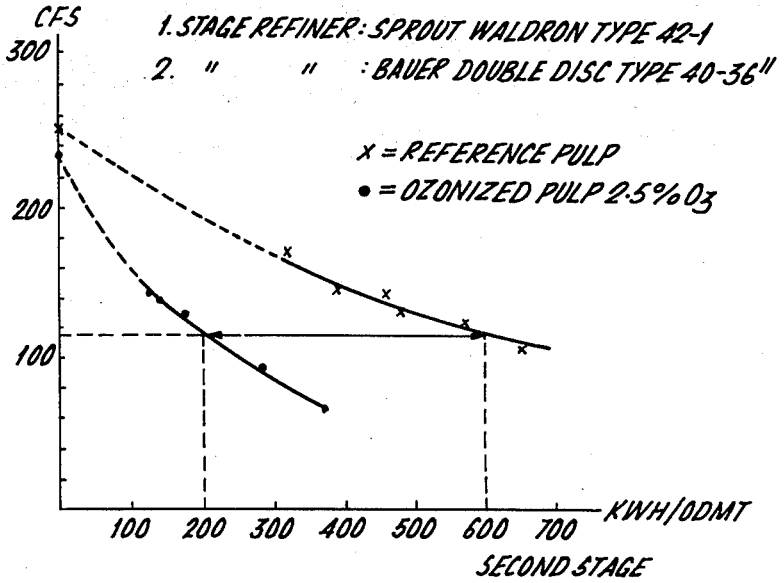
FIGS. 2*a* and 2*b* are diagrams illustrating the difference in energy consumption in a conventional method and a method according to the invention.

In FIG. 1*a*, which is a simplified flow diagram of a known method for treating cellulose containing pulp with ozone, 1 designates a first stage grinding apparatus or refiner which processes a raw material in the form of short-wood or chips to a ground or refined pulp, respectively. The pulps may commonly be designated as mechanical pulp or cellulose containing high yield pulp.

From the apparatus 1 the defibrated pulp is passed to a second stage grinding apparatus or refiner 1*a*, and therefrom the finely divided mechanical pulp is passed to a fractionating device 2, in which the pulp is fractionated in a coarse fraction which is supplied to a dewatering/pressing device 3, and a fine fraction which, for, example is conveyed to an ozonizer (not illustrated). Having a solids content of approximately 35–50%, the coarse fraction is passed from the dewatering/pressing device 3 to a fluffer 4 in which it is given a light and fluffy consistency, whereafter it is conveyed to an ozonizer 5, the pulp having approximately the same solids content as when leaving the dewatering/pressing device 3.

After the ozone treatment in the apparatus 5 the treated coarse fraction is passed directly into a high consistency maturation reactor 6, from which, subsequent to a suitable maturation time, it is passed through a dewatering apparatus 7 and thereafter through an after-refiner 8 to go through a final treatment which has the effect of homogenizing the pulp.

If desired, the dewatering apparatus 7 and the after-refiner 8 may be deleted.

An installation similar to that illustrated in FIG. 1*a* is further described in Norwegian Patent Application No. 77 1471, in which application the advantages associated with a fractionation of the refined pulp in two or more fractions according to particle size have been stated. These advantages involve, inter alia, a more effective utilization of the ozone, the total ozone consumption becoming lower than if the entire pulp was treated with ozone without a preceding fractionation. The fractionation of the refined pulp in two or more fractions according to the particle size also gives the advantage that the dewatering/pressing treatment of the coarse fraction or fractions is facilitated, a pulp suspension being more easily drained the coarser the suspended particles or fibres are.

In a method according to the invention, which is illustrated by the flow diagram of FIG. 1*b*, the favourable properties of the pulp which have been developed in the method according to FIG. 1*a*, are maintained, and there is also achieved a considerable saving of the energy consumption and a considerable simplification of the apparatus necessary for accomplishing a continuous pulp manufacturing process.

In FIG. 1*b*, which is a flow diagram of the method according to the invention, 9 designates a first stage grinding apparatus or refiner which in the same manner as the refiner 1 in FIG. 1*a*, processes a raw material in the form of short-wood or chips to a ground or refined pulp. In the refiner 9 the mechanical or cellulose containing high yield pulp is refined to a freeness level of at least 200 csf, preferably at least 400 csf. The last-mentioned value is of double of the freeness level used in conventional technique before the pulp is subjected to ozone treatment and is passed through a high consistency maturation. Thus, from the refiner 9 the pulp having a temperature of approximately not more than 70° C., is passed to an ozonizer 10 which may be of the type disclosed in Norwegian Patent Application No. 75 3661, and which is connected to a maturation reactor 11, preferably of the type disclosed in Norwegian Patent Application No. 77 1473. When an ozonizer 10 of the type disclosed in the above-mentioned Norwegian Patent Application is used, the processing time may be reduced to a minimum. In the maturation reactor 11 the ozonized pulp is given a residence time in an alkaline environment of below 30 minutes, preferably below 10 minutes, possibly while being mixed with bleaching chemicals. Such a maturation time corresponds approximately to one third of the processing/maturation time necessary in connection with known techniques. From the maturation reactor 11 the high consistency pulp having a solids content of approximately 10–40%, preferably 16–25%, and having an alkaline pH-value of approximately 7–10, is passed direct and continuously to a second stage grinding apparatus or a refiner 12, in which the pulp is ground to a freeness value of the final product in question. As to newspaper and magazine paper this range usually extends from 80 to 130 csf.

FIG. 2*a* is a graphic representation of the energy saving achieved by using the method according to the invention, compared with a conventional method of this type. In the diagram of FIG. 2*a* there are drafted graphs giving the relation between the energy which is consumed when the pulp is ozonized, and the freeness level of the pulp.

In the experiment two pulps were used, which in FIG. 2*a* are designated reference pulp and ozonized pulp, respectively, both pulps being produced in the same two step refining process, in which a Sprout Waldron disc refiner 42″ constituted the first step and a Bauer disc refiner 36″ constituted the second step.

In the first refining step both pulps were treated in the same manner, whereas the reference pulp was thereafter further refined in a conventional manner, and the ozonized pulp was treated according to the present invention.

If a freeness value of 108 csf is desired for the finished end product, it is seen that an energy saving of a total of 400 kwh/odt is achieved. However, also the ozone treatment of the ozonized pulp requires energy. The pulp designed "ozonized pulp" in FIG. 2*a* was treated with 2.5% $O_3$ (weight-% per odt) which means a total of 300 kwh/odt, the production of 1 kg $O_3$ requiring 12 kwh.

The net energy saving at this freeness value is 100 kwh/odt, and an ozonized pulp having a substantially higher strength figure is also achieved. Generally the increase of strength for a spruce pulp which is referred to here, will be approximately 50–70% for the tensile index and approximately 10–40% as to the tear index.

Figure 2B:
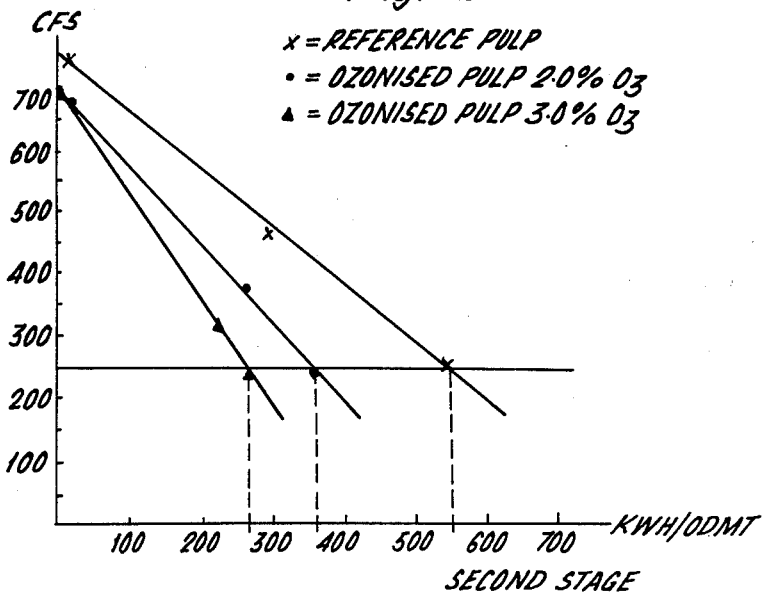

If ozone treatment is carried out on a coarser pulp which for example may have a freeness of approximately 700 csf an energy saving as illustrated in FIG. 2*b* is achieved. To simplify the comparison to finer pulps, the coarser pulp was refined to a freeness of 250 csf which corresponds to the initial freeness shown in FIG. 2*a*. When comparing FIGS. 2*a* and 2*b* it is seen that theoretically a gross energy saving of 750 kwh/odt could be achieved if a very coarse pulp is ozonized prior to its refining to a freeness of approximately 100 csf, the value which is chosen as reference.

Figure 3:
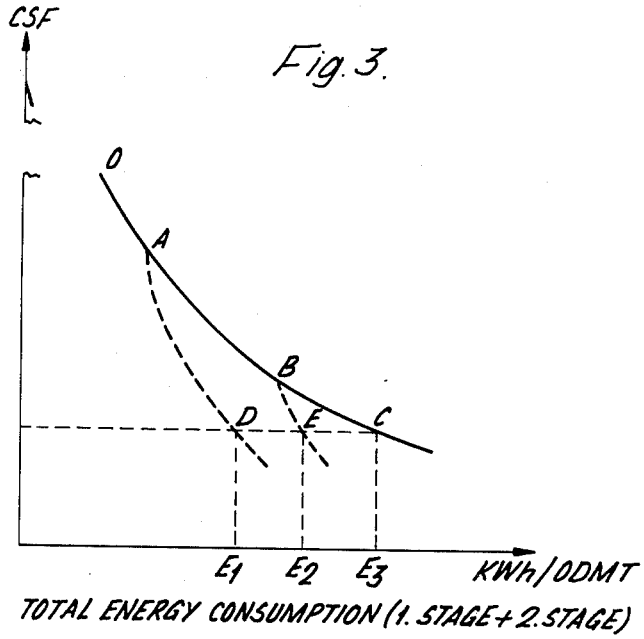
FIG. 3 is a diagram illustrating the relationship between the energy consumption and freeness in ozone treatment of cellulose containing pulp.

On the basis of the measuring data hitherto achieved, it is possible to depict a fairly good picture of the functional relation between csf and kwh/odt with and without ozone treatment. In FIG. 3 this functional relation is illustrated in further details, the diagram of this figure clearly indicating the reduction of energy consumption which can be gained with increasing freeness in the ozone treatment.

In this connection it is to be mentioned that in the refining of chips soaked in chemicals or in connection with direct supply of chemicals in the refiner for the production of mechanical pulps for newspaper and magazine paper, no reduction of the energy consumption has been observed, contrary to what has been achieved in the method according to the invention.

If chips soaked in chemicals (sulphate-impregnated spruce chips) are subjected to ozone treatment in accordance with the present invention, there is achieved an energy reduction of 38% at 2% Oz and 56% at 3% Oz, respectively, measured at a freeness of 300 csf.

Figure 4:
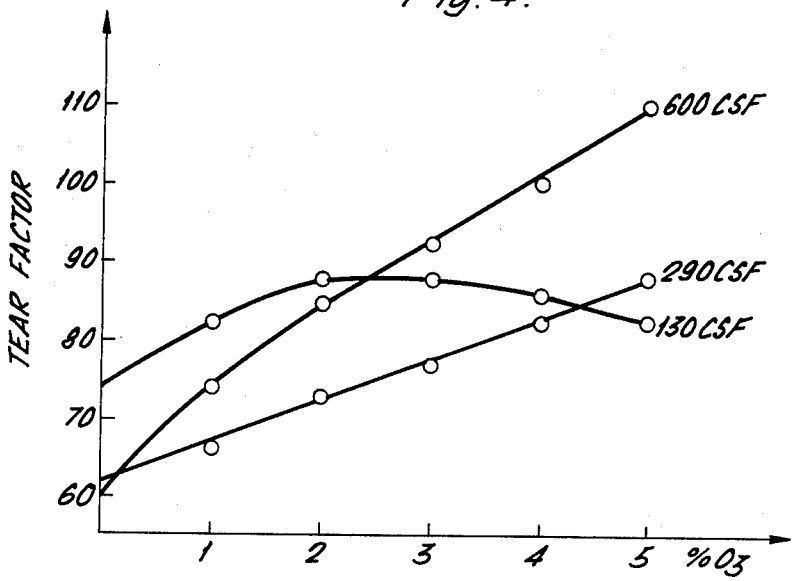
FIG. 4 is a diagram illustrating the tear factor as a function of the ozone consumption at various freeness values.

The method according to the invention also offers a more effective utilization of the ozone when this is calculated as an increase of the tear strength at various freeness levels. In FIG. 4 there is shown a diagram which illustrates the tear factor as a function of the ozone consumption at various freeness values. From the diagram of FIG. 4 it appears that the increase percent of the tear strength at 2.5% ozone is 30% for a pulp having a freeness of 130 csf, whereas the increase is a total of 63% for a pulp having a freeness of 600 csf.

Figure 5:
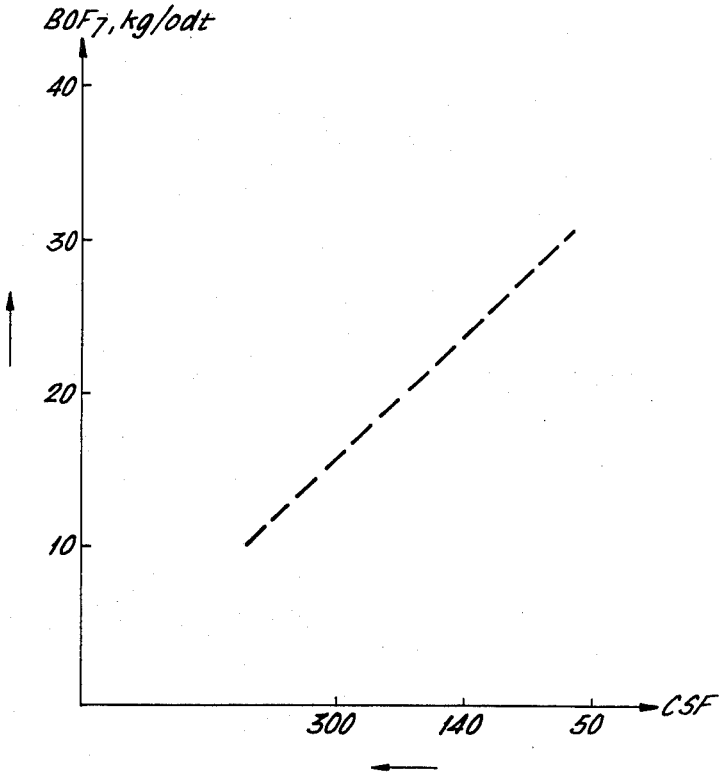
FIG. 5 illustrates the quantity of dissolved organic material as a function of the freeness values.

Compared with earlier known techniques dealing with ozone treatment the method according to the invention also offers a favourable effect as to the quantity of dissolved organic material. In FIG. 5 there is illustrated how the quantity of dissolved organic material depends on the freeness value of the pulp. The quantity of dissolved or released organic material is here measured as biological oxygen demanding material as viewed in relation to freeness. On the basis of measurements which have been carried out, it is observed that the results are parallel to those which appear in connection with an investigation of non-ozonized pulp carried out by Inden, Norberg, Nørrstrom, Sørmark and Ullmann, as this is stated in a report "Utsläpp vid tillverking av mekanisk massa" (Discharge in connection with the processing of mechanical pulp) published in Meddelelse fran Svenska Träföredlingsinstitutet, B:326 (1975).

Figure 6:
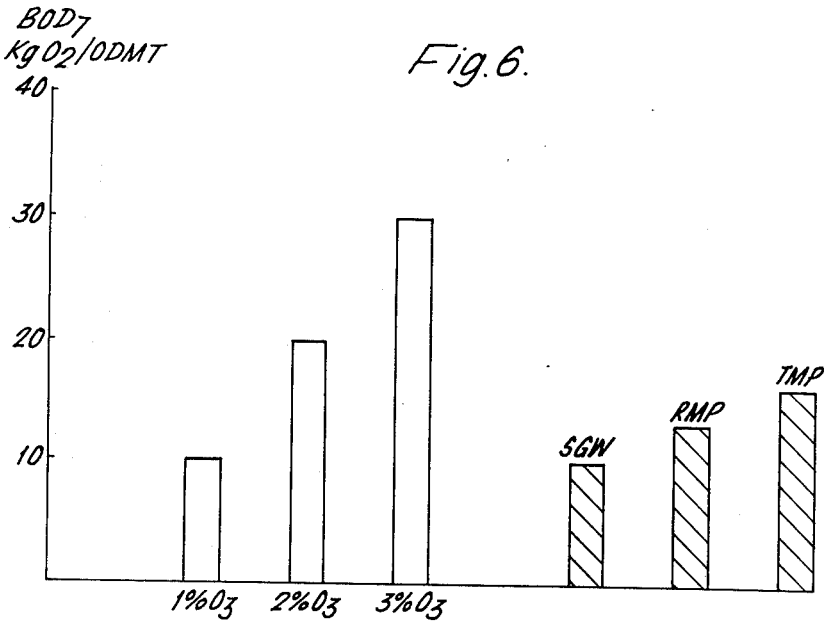
FIG. 6 shows the quantity of dissolved organic material at various pulp types.

To the right in FIG. 6 bar diagrams illustrate how the quantity of released organic material varies according to the method used for the manufacturing of the pulp, i.e. whether the pulp is a ground pulp (SGW: store ground wood), refined pulp (RMP) or thermo mechanical pulp (TMP). To the left in FIG. 6 there is indicated how the quantity of released organic material varies with the quantity of ozone used during the ozone treatment. The figures refer to pulps having a freeness level of approximately 100 csf.

Figure 7:
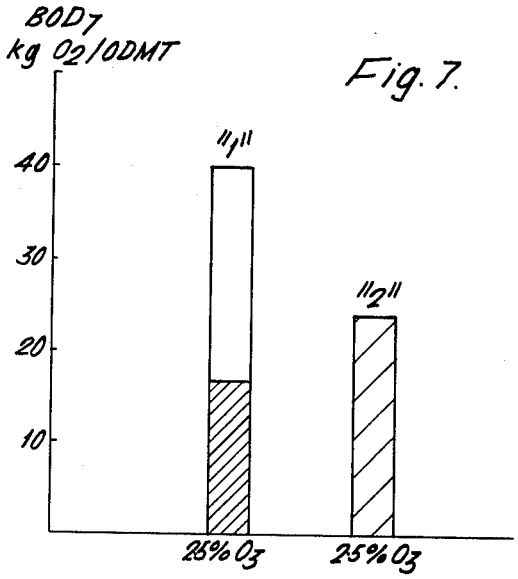
FIG. 7 shows the total quantity of dissolved organic material at a particular ozone treatment.

In FIG. 7 there are depicted examples of how much organic material is released when using known technique and the technique of the present invention, respectively, the ozone treatment in both cases being carried out with 2,5% Oz. The column to the left, designated "1", shows the total quantity of organic material released when using known technique, whereas the column "2" to the right shows the corresponding reduced quantity resulting from the present art. The date of FIG. 7 refers to a freeness level of approximately 100 csf. As it appears from FIG. 7 the release of organic material is reduced to approximately one half when practising the present invention, a fact which is of great importance as to the environment.

Figure 8:
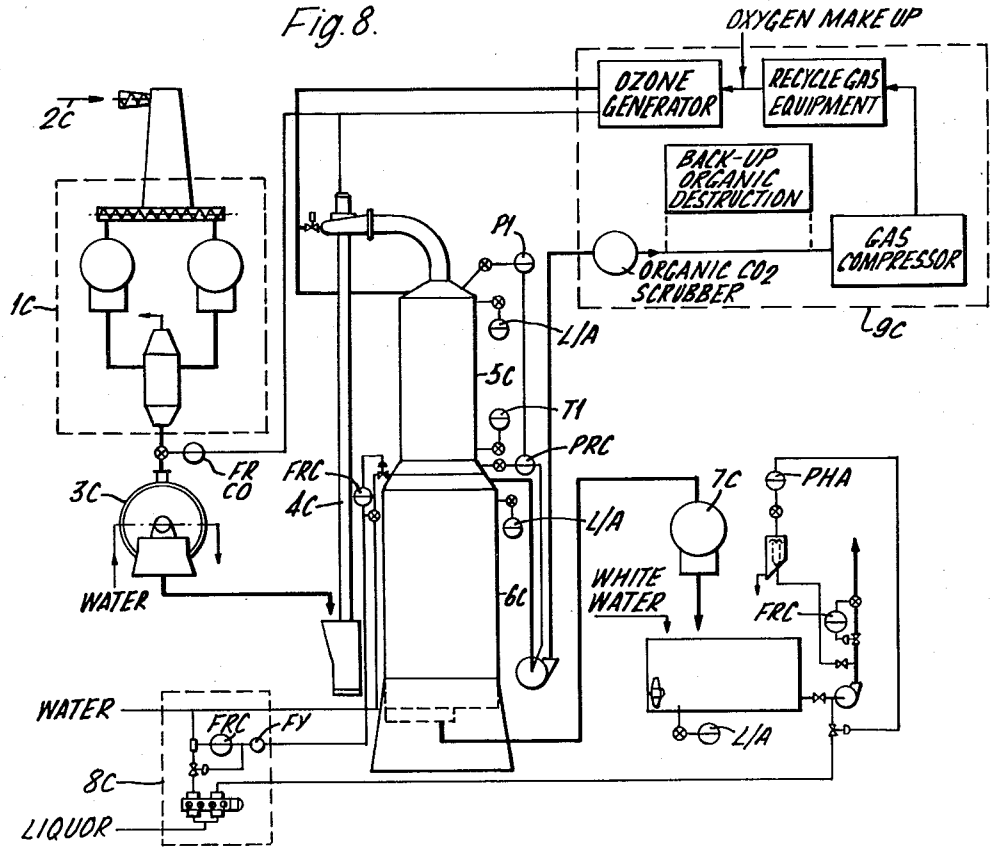
FIG. 8 is a simplified layout of a complete pulp processing plant, on which the present invention is implemented.

FIG. 8 is a simplified layout of a complete pulp treatment plant in which the present invention is included. The block 1*c* embraces a first step refiner (thermo plant) to which is supplied pulp as indicated by the arrow 2*c*. 3*c* is a water cooled cooler unit through which the pulp passes before being fed into a closed conveyer system of the type which is further described in Norwegian Patent Application No. 77 1474. Via the conveyer system 4*c* the pulp is brought to a reactor plant comprising an ozonizer 5*c* and a high consistency maturation reactor 6*c* connected to the ozonizer. The reactors 5*c* and 6*c* may preferably be of the type as described in Norwegian Patent Application No. 77 1473, and from the mentioned reactor the ozonized and matured pulp is passed to a second stage refiner 7*c*. Otherwise, the plant illustrated in FIG. 8 comprises a water and lye distribution unit 8*c*, a gas generation and recirculation unit 9*c* as well as further equipment and devices which are described in more detail in the patent applications referred to above.

What we claim is:

1. In a method for continuously treating refined mechanical pulp and thermo-mechanical pulp in which the pulp is subjected to a first stage refining process, treated with ozone and subsequently treated in a second stage refining process, wherein the improvement comprises:
   (a) refining the pulp in said first stage refining process, by means of a single grinding step to a freeness value of at least 200 csf, and a dry substance consistency of 20–60%,
   (b) cooling the refined pulp to a temperature below approximately 70° C.,
   (c) treating the cooled pulp with ozone,
   (d) treating the ozonized pulp in a high-consistency maturation reactor in which a material selected from the group consisting of alkali and bleaching chemicals is added for not more than 30 minutes to produce a high-consistency pulp having a solids content of between 10–40% and a pH in the range of 7–10,
   (e) passing the matured, high consistency pulp directly and continuously to a second stage refiner,
   (f) grinding the pulp in said second stage refiner by means of a single grinding step to a desired freeness value.

2. The improvement of claim 1, wherein the pulp after being treated in the high-consistency maturation reactor of step (d) has a dry substance content of 16–25%.

3. The improvement of claim 1, wherein in step (a), the pulp is refined to a freeness value of at least 400 csf.

4. The improvement of claim 1, wherein in step (d), the treatment time of the ozonized pulp in the high-consistency maturation reactor is limited to not more than 10 minutes.

5. The improvement of claim 1, wherein in step (f), the desired freeness value is approximately 80–130 csf.

* * * * *